US006076435A

United States Patent [19]

White, Sr. et al.

[11] Patent Number: 6,076,435

[45] Date of Patent: Jun. 20, 2000

[54] TOOL FOR MULTIPLE PURPOSES

[76] Inventors: Andrew C. White, Sr., 771 Lincoln Park Pl., Kingston, N.Y. 12401; Mitchell I. Rapoport, MacDaniel Rd., Woodstock, N.Y. 12498; Gregory R. Becker, R.R. 2 Box 182 Rt. 199, Red Hook, N.Y. 12571

[21] Appl. No.: 08/947,961

[22] Filed: Oct. 9, 1997

[51] Int. Cl.[7] ..... B25B 13/48

[52] U.S. Cl. ..... 81/176.2; 81/461; 7/138

[58] Field of Search ..... 81/176.2, 461, 81/176.1, 176.15, 177.85, 125.1, 119, 176.3, DIG. 7, DIG. 8; 7/100, 138

[56] References Cited

U.S. PATENT DOCUMENTS 423,288 3/1890 Tefft et al. ..... 81/176.15 X 1,531,001 3/1925 Graves ..... 81/125.1 X 2,291,846 4/1942 Taylor ..... 81/176.1 X 2,742,804 4/1956 Chase et al. ..... 81/176.3 X

*Primary Examiner*—D. S. Meislin

[57] ABSTRACT

A tool for multiple purposes including turning valve wheels, opening drum plugs and vents, driving sockets, turning screws, use as a drift pin and prying, among other possible uses, the tool having a handle and an exterior shank and an interior shank, each shank having a square cross section and being in a spaced relationship and parallel to one another located at one end of the handle, the opposite end of the handle having an edge and the handle being tapered, the interior shank which is located furthest from the end of the handle having an outer end with a reduced size set off center so that the wall of that shank toward the edge is aligned along the entire interior shank.

16 Claims, 4 Drawing Sheets

TOOL FOR MULTIPLE PURPOSES

BACKGROUND OF THE INVENTION

1. Field of the Invention

This invention relates to a tool for multiple purposes and more particularly to a tool for turning valve wheels and handles, turning plugs in barrel or drum pour openings and air vents, driving sockets, use as a drift pin, turning screws and prying, among other uses.

2. Description of the Prior art and Objects of the Invention

It is a well recognized problem that valves, both large and small, can be difficult to turn. Steam plants, chemical plants and refineries, ships, food processing plants, among a wide variety of operations, have valves covering a wide range of sizes, the activation of which can be difficult to turn without some assistance. Frequently in locations where valves are located, drums or barrels are also used and which must be opened and closed. A need exists for a simple durable valve-actuating tool which can be readily carried by an operator in such a plant.

Previously, tools have been developed to handle separately certain of the capabilities of the present invention. The Pella Patent, U.S. Pat. No. 4,715,252 teaches a valve wrench with a rim grip and a spoke grip. This device works on a large wheel and grasps the wheel in one way, namely a spoke adjacent the rim and on an annular portion of the rim itself. The device taught by Pella does provide a useable device for wheels that are sufficiently large and have compatible design. The device taught by Pella is bulky, and if made of a light metal such as aluminum, breaks easily and is still bulky to carry. The device taught by Pella can be difficult to use in a restricted or confined space due to the limited manner in which the device of Pella can be mounted on a wheel. The Pella device has no application for opening and closing drums or other uses and is limited as to the valve wheels that it can engage. The device of Pella must also be removed from a wheel and be repositioned when changing the direction of rotation.

A wrench for turning the plugs in drums or barrels is taught in the Umbdenstock Patent, U.S. Pat. No. 2,421,665. Umbdenstock teaches a handle with a series of tangs extending from two opposite sides of a handle. All the protrusions or tangs have a rectangular elongated cross section and several of the tangs have V-shaped edges. The tangs are spaced from one another so that a variety of combinations are available to engage plugs of various sizes and shapes. This device clearly met a need in its day but plugs in drums, although not all the same, have been greatly standardized. Also, drums also have an opening used as a vent, in addition to the opening for pouring and filling, which needs to opened and closed and most preferably with the same tool used to open the pour opening for filling and pouring. Umbdenstock does not deal with that issue.

Accordingly, it is an object of the present invention to provide a tool which among other uses can engage, actuate and operate valves of a wide variety of sizes and configurations and also to open and close pour openings and vent openings of drums and barrels.

Accordingly, it is a further object of the present invention to provide a tool which, among other uses, can engage the wheel of a valve on either a spoke, a rim or both depending on the size, configuration and location of the wheel.

Accordingly, it is a further object of the present invention to provide a tool which, among other uses, can be used as a drive for sockets of two different sizes.

Accordingly, it is a further object of the present invention to provide a tool, which among other uses, can be used as both a screw driver and as a pry bar.

Accordingly, it is a further object of the present invention to provide a tool, which among other uses, can be used as a drift pin for aligning openings in multiple layered work pieces.

Accordingly, it is a further object of the present invention to provide a tool which can be produced economically.

Accordingly, it is a further object of the present invention to provide a tool which is strong, durable and rugged.

Accordingly, it is a further object of the present invention to provide a tool which can be easily carried to be available as needed in the work area.

Accordingly, it is an object of this invention to provide a tool which can be manufactured by various techniques using different materials.

These and other objects and advantages of the present invention will become apparent to those of ordinary skill in the art as the description thereof proceeds.

SUMMARY OF THE INVENTION

A multiple purpose tool is provided having a handle with an exterior shank and an interior shank extending from one side of the handle an at one end of the handle and in a spaced relationship to one another. The outer end of the interior shank has a reduced size and is offset to retain the outside dimension between the two shanks constant for the entire length of both shanks. The end of the handle remote from the shanks has a chisel section with an edge and the handle from the shanks to the chisel section is gradually tapered.

DESCRIPTION OF THE DRAWINGS

The invention may be readily understood by referring to the accompanying drawings, in which.

DESCRIPTION OF THE PREFERRED EMBODIMENT

Figure 1:
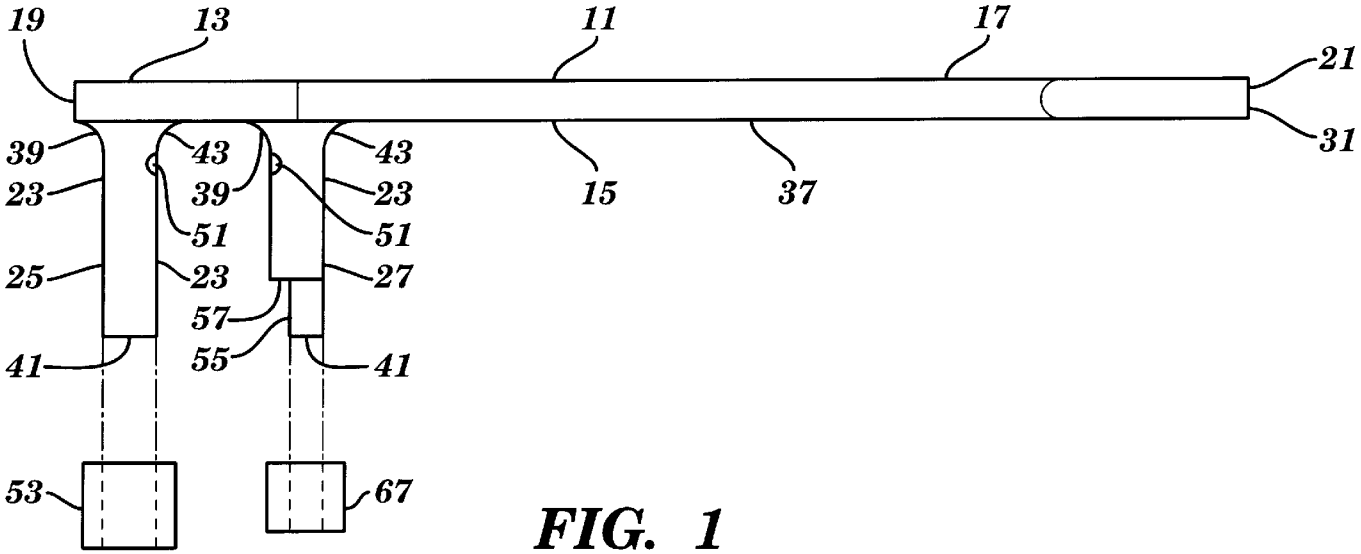
FIG. 1 is a side elevation of the tool having the handle with an edge at one end and a pair of shanks extending form one side of the handle at one end of the handle and in a spaced relationship to one another and showing sockets that may be used on the shanks.
Figure 2:
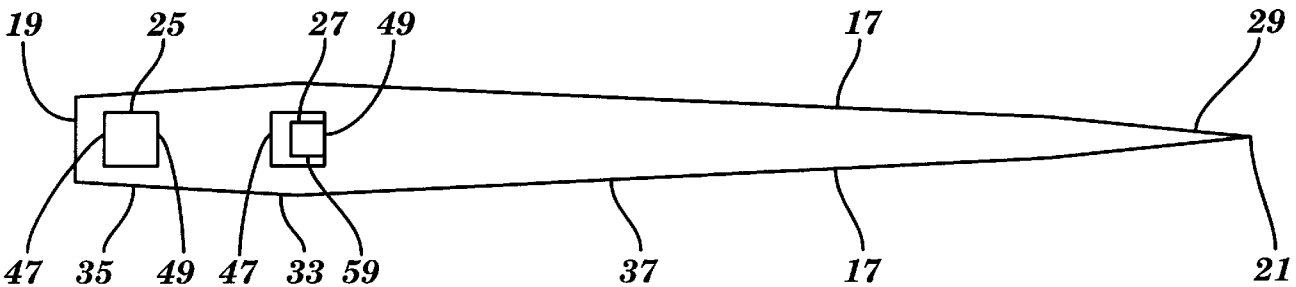
FIG. 2 is a bottom view of the tool showing the taper of the handle and the chisel section of the handle with an edge at the end remote from the shanks.

The tool, in accordance with this invention, as best seen in FIG. 1 and in FIG. 2 includes a handle 11 having a top surface 13, a bottom surface 15, two side surfaces 17, a front end 19 and a back end 21. Extending at right angles from the bottom surface 15 and generally parallel to one another are two shanks 23, namely an exterior shank 25 and an interior shank 27, the exterior shank 27 being located at the front end 19 of the handle 11 and the interior shank 27 being located in a spaced relationship to the exterior shank 25 toward the front end 19 of the handle 11.

The top surface 13 and the bottom surface 15 of the handle 11 have substantially the same configuration. The front end 19 of the handle 11 is blunt. The distance between the top surface 13 and the bottom surface 15 is substantially constant and both side surfaces 17 thus have substantially the same width. At the back end 21 of the handle 11, the side surfaces 17 are beveled to form a chisel section 29 with an edge 31 at the back end of the handle 11. The edge 31 is generally aligned with both the exterior shank 25 and the interior shank 27. At the location of the interior shank 27, the distance between the two side surfaces 17, as measured on the top surface 13 and the bottom surface 15, is the greatest along the entire handle 11 forming a wide section 31 of the handle 11. The top surface 13 and the bottom surface 15 are tapered from the wide section 33 to the front end 19 forming a front section 35 which is a minor portion of the length of the handle 11. Similarly, the top surface 13 and the bottom surface 15 of the handle 11 taper from the wide section 33 to the chisel section 29 forming a back section 37 which is the major part of the handle 11. The chisel section 29 of the handle is even shorter than the front section 35 of the handle 11.

Both the exterior shank 25 and the interior shank 27 have a square cross section. Each shank 23 is secured to or is preferably formed with the handle 11 and 10 has an inner end 39 and an outer end 41. The inner end 39 is secured to the handle 11 and the outer end 41 is remote from the handle 11. Fillets 43 are formed at the inner end 39 of each shank 23 with the bottom surface 15 of the handle 11 extending toward the front end 19 and the back end 21 of the handle. Each shank 23 has two side surfaces 45, a front surface 47 and a back surface 49. The front surface 47 face the front end 19 of the handle 11. The back surfaces 49 face the back end 21 of the handle 11. The side surfaces 45 are substantially at right angles to both the front surface 47 and the back surface 49. Just beneath the fillet 43 at the back surface 49 of the exterior shank 25 at each intersection of the back surface 49 with both side surfaces 45, notches 51 are formed. Similarly, just beneath the fillet 43 at the front surface 47 of the interior shank 27 at each intersection on the front surface 47 of the interior shank 27 with the two side surfaces 45, notches 51 are formed.

Preferably, each shank 23 is one-half inch square. The exterior shank 25 has a generally constant cross section from the fillets to the outer end 41 thereof. The one-half inch square shank 03 provides a driver for use in a socket 53 having a one-half inch drive opening. The interior shank 27 also has a one-half inch square cross section but at the outer end 41, for a minor portion 55 of the length of the interior shank 27, has a reduced cross section, preferably to three-eights of an inch in cross section. It should be noted that alternate shank dimension, as for example, those consistent with metric tooling, may also be used.

The back surface 49 of the interior shank 27 extends from the fillet 43 to the outer end 41, but the front surface 47 has an indentation 57 twice that of the indentation 59 at the side surfaces 45 of the interior shank 27, As a result, the distance from the front surface 47 of the exterior shank 25 to the back surface 49 of the interior shank 27 remains substantially constant through the entire length of both the exterior shank 25 and the interior shank 27. The distance from the front surface 47 of the exterior shank 25 to the back surface 49 of the interior shank 27 is preferably two inches and this dimension is critical as it permits the tool effectively to fit the plugs 61 (FIG. 8) used in the pour openings of modern day drums 63 and also to provide the optimum space between the interior shank 27 and the exterior shank 25 for the most effective engagement of valve wheels 65 (FIG. 3 through FIG. 7) and other tools where increased leverage is required. The reduced cross section of the outer end 41 of the interior shank 27 to a three-eights square provides a driver for a socket 67 having a three-eights square drive while preserving the needed two inch distance from the front surface 41 of the exterior shank 25 to the back surface 49 of the interior shank 27.

The uses of the tool are numerous and it is not possible to describe each and every one of the ways in which the tool can be beneficial. For example, adjustable open end wrenches (not shown) are well known and such wrenches have an opening at the end of the handle for various reasons only one of which is to hang the open end wrench on a wall. When such a adjustable open ended wrench engages a work piece (not shown) but cannot rotate the work piece because it is too tight, by placing the interior shank 27 into the opening of the open ended adjustable wrench with the exterior shank 25 engaging the edge of the handle of the open ended adjustable wrench greater leverage is provided.

Figure 8:
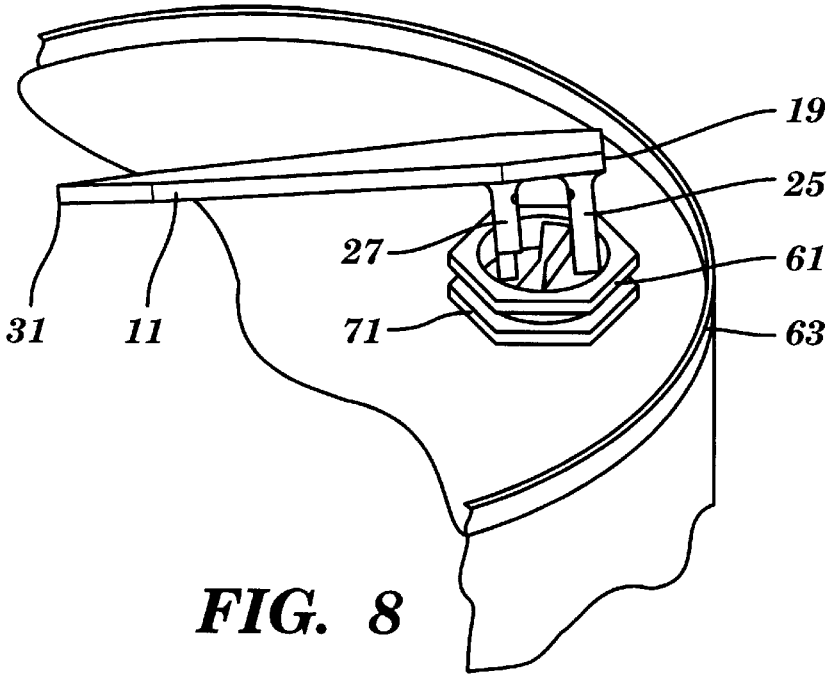
FIG. 8 is a pictorial view of the tool being used to turn a plug for the pour opening of a drum, the plug having a diagonal rim across the plug.
Figure 9:
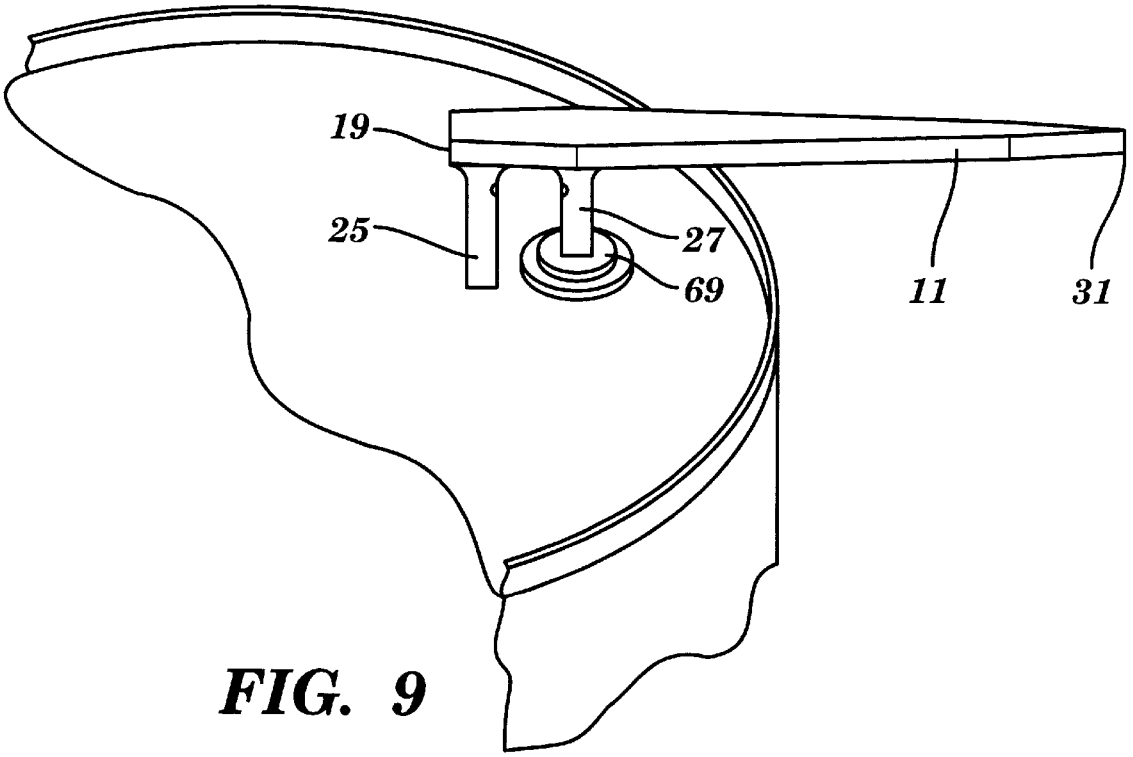
FIG. 9 a pictorial view of the tool being used to turn a vent plug in a drum, the vent plug having a square indentation in a barrel.

The vent plugs 69 of modem day drums, as best seen in FIG. 9 are made with an indentation threeights of an inch square or one half inch square and the outer end 41 of the interior shank 27 fits the smaller opening and the outer end 41 of the exterior shank 25 fit the larger opening thereby providing easy turning of the vent plug 69. Some plugs 61 for pour openings in drums 63 have a square indentation which is one half inch square and which is readily engaged by the exterior shank 25 for easy turning of the plug 61 for pour openings. Other plugs 61 for pour openings have a rib 71 diametrically located on the exterior of the plug, as best seen in FIG. 8, and the combination of the exterior shank 25 and the interior shank 27 fit within the plug 61 and lock on the rib 71 to provide easy opening of the plug 61.

The edge 31 on the back end 21 on the handle 11 provides both a screw driver and a pry bar. Both the interior shank 27 and the exterior shank 25 serve as a driver for sockets 53, 67, as shown in FIG. 1.

Figure 3:
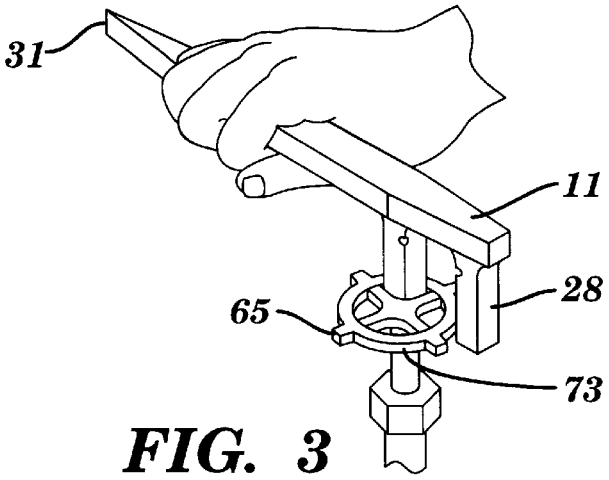
FIG. 3 is a pictorial view showing the tool being used on a valve wheel that is comparatively small with the interior shank being used to lock to the wheel inside the rim with the other shank engaging an exterior spoke extending outside the rim of the wheel to provide added leverage to turn the wheel.

A prime use of the tool is to assist in turning valve wheels 65 and similarly handles (not shown) in places such as power plants. In FIG. 3 through FIG. 7, various applications of the tool to the turning of valve wheels 65 is shown. In FIG. 3 a small wheel 65 is shown on a valve. The wheel 65, depicted in FIG. 3 is small and has openings of limited size.

The outer end 41 of the interior shank 27 fits into the openings on the handle between the spokes and permits the interior shank 27 to lock in place and the tool thereby provides much increased leverage for turning the valve wheel 65.

Figure 4:
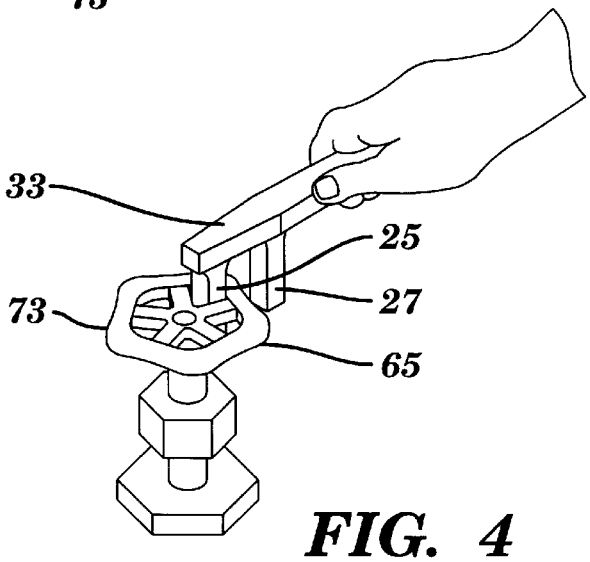
FIG. 4 is a pictorial view of another design of a small wheel with the exterior shank located in an interior opening in the wheel and the interior shank engaging the rim of the wheel to provide leverage to turn the wheel.

The valve wheel 65 shown in FIG. 4 is of a different design but also is a comparatively small valve wheel 65. The valve wheel 65 shown in FIG. 4 has larger opening between the spokes than depicted in FIG. 3 so the outer end 41 of but the exterior shank 25 and the interior shank 27 will not lock in the openings, However, with the exterior shank 25 in the opening and the interior shank 27 engaging the rim 73, the same beneficial leverage is obtained to assist in turning the valve wheel 65.

Figure 5:
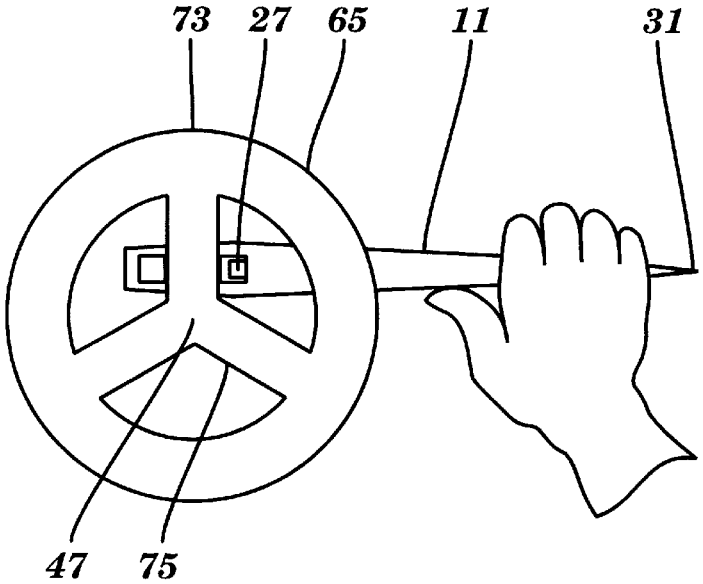
FIG. 5 is a top plan view of a moderately sized wheel with a comparatively thick rim and spokes, the two shanks of the tool engaging one spoke of the wheel adjacent the center point of the wheel from the bottom up to provide leverage to turn the wheel.

In FIG. 5 a comparatively moderately sized valve wheel 65 with comparatively thick spokes 75 in the valve wheel 65. The tool is shown being used from the bottom of the valve wheel 65 but the tool can be used from the top down and that choice will depend upon the space available where the valve wheel 65 to be turned is situated. The shanks 23 of the tool are placed over one spoke 75 as seen in FIG. 5 adjacent the intersection of the spokes 75 with the center hub 77 of the valve wheel 65. The tool can be placed on any spoke 75 at any location on the spoke 75 depending on the leverage desired and most likely upon the ability to access the valve wheel 65.

Figure 6:
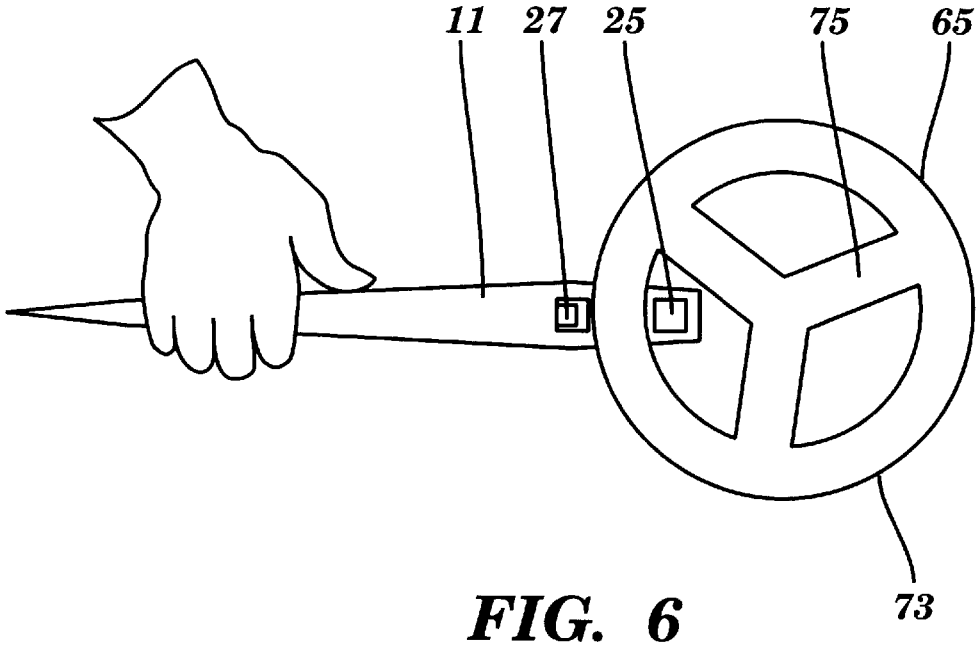
FIG. 6 is a top plan view similar to FIG. 5 showing substantially the same wheel with both shanks of the tool engaging the rim of the wheel.

In FIG. 6 the same valve wheel 65 is shown, as is shown in FIG. 5, but with the tool engaging the valve wheel 65 on the rim 73 and once again from the bottom up. This position on the rim 73 provides the maximum leverage to turn the wheel.

Figure 7:
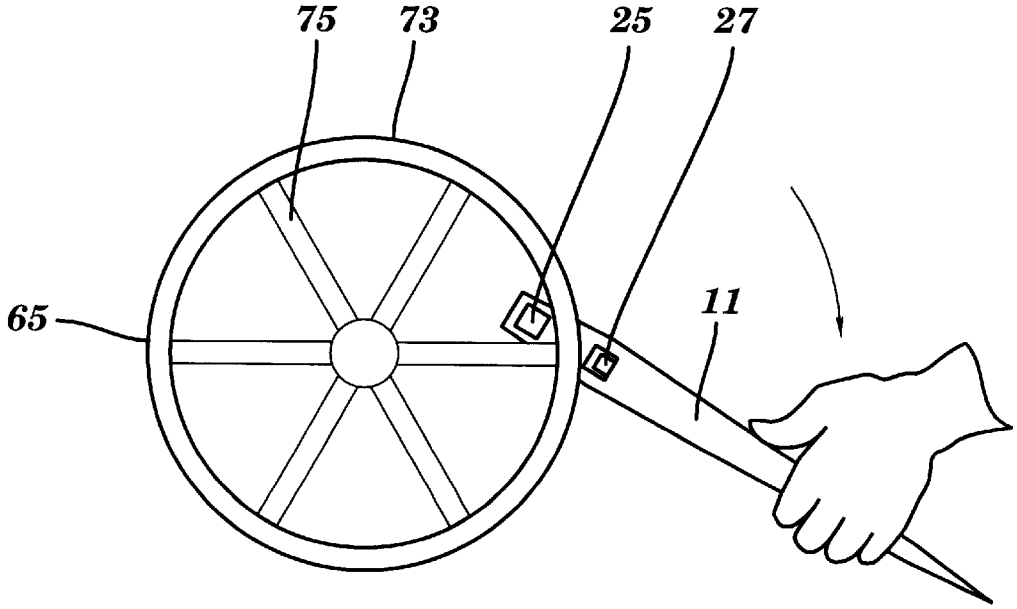
FIG. 7 is top plan view of a comparatively large wheel with a rim and spokes of lesser thickness compared to FIG. 5 and FIG. 6 and with the exterior shank engaging the interior of the rim at the junction point with a spoke and with the interior shank engaging the exterior of the rim.

In FIG. 7, a comparative large valve wheel 65 is shown having comparatively thinner spokes 75 and rim 73. Here too the valve wheel 65 can be easily engaged by placing the exterior shank 25 at the intersection of a spoke and the rim 73 inside the rim 73 and the interior shank 27 against the outside of the rim 73.

The back section 37 of the handle 11 of the tool is tapered and this makes the tool very suitable as a drift pin to align holes (not shown) which is a need that does occur in a wide variety of situations. The edge 31 at the back end 21 of the tool can be used as a screw driver and also as a chisel or pry bar.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

The claims are:

1. A tool for multiple purposes comprising:

a handle, the handle being an elongated bar, the handle having a front end and a back end and a top surface and a bottom surface and two side surfaces, the top surface and the bottom surface of the handle each including;

a wide section which has the greatest distance between the two side surfaces, the wide section being located generally where the interior shank is secured to the bottom of the handle;

a front section extending from the side section to the front end and being tapered from the wide section to the front end, the front end being blunt;

a chisel section including an edge extending to the back end, the chisel section being beveled to an edge at the back end;

a rear section extending from the side section to the chisel section and being tapered from the side section to the chisel section;

an exterior shank secured to the bottom surface of the handle generally at right angles to the handle, the exterior shank having an outer end remote from the handle; and an interior shank secured to the bottom surface of the handle generally at right angles to the bottom surface adjacent the front end of the handle and in a spaced relationship with the exterior shank, both the exterior shank and the interior shank having an outer end, the outer end being remote from the bottom surface of the handle, the outer end of the exterior shank and the outer end of the interior shank being generally square, one outer end being smaller than the other outer end and being offset away from the other outer end.

2. A tool according to claim 1 wherein the exterior shank is located at the front end of the handle.

3. A tool according to claim 1 wherein the interior shank has an outer end smaller than the outer end of the exterior shank.

4. A tool according to claim 1 wherein both the exterior shank and the interior shank have a pair of notches cut in the interior shank and the exterior shank adjacent the handle, each pair of notches generally facing the other pair of notches.

5. A tool for multiple purposes, comprising:

a handle, the handle being an elongated bar, the handle having a front end and a back end and a top surface and a bottom surface and two side surfaces;

an exterior shank secured to the bottom surface of the handle at the front end of the handle generally at right angles to the handle, the exterior shank generally having a square cross section and having a front surface facing the front end of the handle and a back surface facing the back end of the handle and two side surfaces between the front surface and the back surface, the exterior shank having an outer end remote from the bottom surface of the handle; and an interior shank secured to the bottom surface of the handle generally at right angles to the bottom surface adjacent the front end of the handle and in a spaced relationship with the exterior shank, the interior shank generally having a square cross section, the interior shank having an outer end remote from the bottom surface of the handle, the interior shank having a front surface facing the front end of the handle and a back surface facing the back end of the handle and two side surfaces between the front surface and the back surface, one of the two outer ends being smaller than the other outer end and being offset away from the other outer end ,the exterior shank and the interior shank both being approximately one-half inch square and the smaller outer end being approximately three-eights inch square.

6. A tool according to claim 5 wherein the handle has an edge at the back end.

7. A tool according to claim 5 wherein the handle has an edge at the back end, the edge being aligned with the interior shank.

8. A tool according to claim 5 wherein the top surface and the bottom surface of the handle each include:

a wide section which has the greatest distance between the two side surfaces, the wide section being located generally where the interior shank is secured to the bottom surface of the handle;

a front section extending from the wide section to the front end and being tapered from the wide section to the front end, the front end being blunt;

a chisel section including a edge extending to the back end, the chisel section being beveled to an edge at the back end;

a rear section extending from the wide section to the chisel section and being tapered from the wide section to the chisel section.

9. A tool according to claim 5 wherein the interior shank has the smaller.

10. A tool according to claim 5 wherein both the exterior shank and the interior shank have a pair of notches cut in the interior shank and the exterior shank adjacent the handle, each pair of notches generally facing the other pair of notches.

11. A tool according to claim 5 wherein the front surface of the exterior shank extends from adjacent the bottom surface of the handle to the outer end of the exterior shank and the back surface of the interior shank extends from adjacent the bottom surface of the handle to the outer end of the interior shank.

12. A tool according to claim 5 wherein the distance between the front surface of the exterior shank and the back surface of the interior shank is approximately two inches.

13. A tool for multiple purposes comprising:

a handle, the handle being an elongated bar, the handle having a front end and a back end and a top surface and a bottom surface and two side surfaces, the front end being blunt, the handle further including;

a wide section which has the greatest distance between the two side surfaces a front surface extending from the wide section to the front section and being tapered from the wide section to the front end, a chisel section including an edge extending to the back end, the chisel section being beveled to the edge at the back end, and a rear section extending from the wide section to the chisel section and being tapered from the wide section to the chisel section;

an exterior shank secured to the bottom surface of the handle at the front end of the handle generally at right angles to the handle, the exterior shank generally having a square cross section and having a front surface facing the front end of the handle and a back surface facing the back end of the handle and two side surfaces between the front surface and the back surface, the exterior shank having an outer end remote from the bottom surface of the handle; and an interior shank secured to the bottom surface of the handle generally at right angles to the bottom surface adjacent the front end of the handle and in a spaced relationship with the exterior shank generally at the wide section of the bottom surface, the interior shank generally having a square cross section, the interior shank having an outer end remote from the bottom surface of the handle, the interior shank having a front surface facing the front end of the handle and a back surface facing the back end of the handle and two side surfaces between the front surface and the back surface, one of the two outer ends being smaller than the other outer end and being off set away from the other outer end and being off set away from the other outer end, a pair of notches cut in the interior shank and the exterior shank adjacent the handle, each pair of notches generally facing the other pair of notches.

14. A tool according to claim 13 wherein the front surface of the exterior shank extends from adjacent the bottom surface of the handle to the outer end of the exterior shank and the back surface of the interior shank extends from adjacent the bottom surface of the handle to the outer end of the interior shank.

15. A tool according to claim 13 wherein the distance between the front surface of the exterior shank and the back surface of the interior shank is approximately two inches.

16. A tool according to claim 13 wherein the exterior shank and the interior shank are both approximately one-half inch square and the smaller outer end is approximately three-eights inch square.

* * * * *